US012723504B1

(12) United States Patent
Brands

(10) Patent No.: US 12,723,504 B1
(45) Date of Patent: Sep. 1, 2026

(54) WELLBORE SURVEYING AND RANGING DATA INTEGRATION

(71) Applicant: Schlumberger Technology Corporation, Sugar Land, TX (US)

(72) Inventor: Sjoerd Brands, The Hague (NL)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 19/277,861

(22) Filed: Jul. 23, 2025

(51) Int. Cl.
*E21B 47/022* (2012.01)
*E21B 7/04* (2006.01)
*E21B 7/06* (2006.01)

(52) U.S. Cl.
CPC ..... *E21B 47/022* (2013.01); *E21B 7/046* (2013.01); *E21B 7/06* (2013.01)

(58) Field of Classification Search
None
See application file for complete search history.

(56) References Cited

U.S. PATENT DOCUMENTS 8,570,834 B2 * 10/2013 McElhinney ..... G01S 5/22 367/127
9,464,482 B1 * 10/2016 Bargach ..... E21B 44/005
9,657,561 B1 * 5/2017 Bargach ..... E21B 47/022
12,084,959 B2 * 9/2024 Collins ..... E21B 44/00
12,291,966 B1 * 5/2025 Montois ..... E21B 47/0232
2002/0133958 A1 * 9/2002 Noureldin ..... G01C 21/166 33/304
2007/0126426 A1 * 6/2007 Clark ..... G01V 3/26 324/326
2008/0041626 A1 * 2/2008 Clark ..... G01V 3/26 340/854.6
2008/0275648 A1 * 11/2008 Illfelder ..... E21B 47/022 702/10
2009/0030615 A1 * 1/2009 Clark ..... E21B 47/0228 175/45
2009/0120690 A1 * 5/2009 Phillips ..... E21B 47/022 175/45
2009/0260878 A1 * 10/2009 Morley ..... E21B 43/305 175/45
2009/0260879 A1 * 10/2009 Clark ..... E21B 43/2406 175/45
2015/0143889 A1 * 5/2015 Kim ..... G01V 7/00 702/6

(Continued)

OTHER PUBLICATIONS

"Inclination and Azimuth—Trenchless Engineering"—www.trenchlessengineering.com.au/inclination-azimuth/—accessed Feb. 6, 2026 via the Internet Archive (Year: 2023).*

(Continued)

*Primary Examiner* — Blake Michener
(74) *Attorney, Agent, or Firm* — Jeffrey D. Frantz

(57) ABSTRACT

A method for drilling a second wellbore in proximity to a first wellbore includes obtaining a first trajectory for the first wellbore, drilling the second wellbore in proximity to the first wellbore, making wellbore surveying measurements in the second wellbore and computing the trajectory of the second wellbore, making ranging measurements at a plurality of ranging locations in a ranging interval of the second wellbore, and transforming the ranging interval of the second trajectory to fit selected ones of the plurality of ranging measurements.

19 Claims, 4 Drawing Sheets

(56) References Cited

U.S. PATENT DOCUMENTS

| | | | | |
|---|---|---|---|---|
| 2015/0378043 | A1* | 12/2015 | Brooks | E21B 7/06 702/9 |
| 2017/0138173 | A1* | 5/2017 | Estes | E21B 7/04 |
| 2019/0032472 | A1* | 1/2019 | Ahmadi Kalateh Ahmad | E21B 47/0228 |
| 2025/0376922 | A1* | 12/2025 | Richards | E21B 47/0228 |

OTHER PUBLICATIONS

Williamson, H.S., "Accuracy Prediction for Directional Measurement While Drilling", SPE-67616-PA, Spe Drillilling & Completions, 2000, vol. 15, No. 4, pp. 221-233.

Mantle K. et al., "Directional Drilling Practices", SLB, Retrieved from the internet: https://www.slb.com/resource-library/oilfield-review/defining-series/defining-directional-drilling, Oct. 1, 2014, 2 pages.

Nekut, A. G. et al., "Rotating Magnet Ranging—a new drilling guidance technology", 8th One Day Conference on horizontal well technology Canadian Sections SPE/ Petroleum Society, SPE-CIM-01-01-MS, Nov. 7, 2001, pp. 1-8.

Poedjono, B., "Chapter 8 Relief/Interception Well Ranging Operations", ISCWSA, Retrieved from the internet: https://www.iscwsa.net/media/files/box/b8d85297/well-intercept-sub-committee-ebook-version-3-2021.pdf, 2021.

* cited by examiner

WELLBORE SURVEYING AND RANGING DATA INTEGRATION

FIELD

Disclosed embodiments relate generally to wellbore surveying methods and more particularly to methods for integrating wellbore surveying and ranging measurements to obtain improved positional control of one wellbore with respect to another during a drilling operation.

BACKGROUND

In subterranean drilling operations the need frequently arises to drill one wellbore (a drilling well) in proximity to a pre-existing offset wellbore (a target well). This need may exist, for example, to avoid a collision, to make an intercept, or to maintain a specified separation distance between the wells (e.g., as in well twinning operations). A significant difficulty with such drilling operations is determining the correct direction of drilling for the drilling well.

Wellbore surveying measurements (inclination and azimuth measurements) are commonly made while drilling and assembled into a three dimensional trajectory that describes the absolute position of the wellbore. However, survey measurement errors (e.g., random and/or bias errors) result in a trajectory uncertainty that compounds with increasing measured depth such that the above described drilling operations cannot be performed based on surveying measurements alone. Such drilling operations commonly make further use of ranging measurements to measure the relative location of the target well with respect to the drilling well. Such ranging measurements may include, for example, magnetic ranging, acoustic ranging, and resistivity ranging techniques.

Survey data and ranging data commonly provide contradictory information to the directional driller owing to measurement errors that cannot be fully eliminated. Such apparent contradictions can be problematic to the directional driller in making steering decisions, especially when the differences are large. There is a need in the industry for improved utilization of surveying and ranging measurements, particularly for improving positional control of one wellbore with respect to another.

SUMMARY

Systems and methods for drilling a second wellbore in proximity to a first wellbore are disclosed. In one example embodiment, a method includes obtaining a first trajectory for the first wellbore and drilling the second wellbore in proximity to the first wellbore. Wellbore surveying measurements are made in the second wellbore and used to compute the trajectory of the second wellbore. Ranging measurements are made at a plurality of ranging locations in a ranging interval of the second wellbore. The ranging measurements measure at least a distance between the first wellbore and the second wellbore. The ranging interval of the second trajectory are transformed to fit selected ones of the plurality of ranging measurements.

This summary is provided to introduce a selection of concepts that are further described below in the detailed description. This summary is not intended to identify key or essential features of the claimed subject matter, nor is it intended to be used as an aid in limiting the scope of the claimed subject matter.

BRIEF DESCRIPTION OF THE DRAWINGS

For a more complete understanding of the disclosed subject matter, and advantages thereof, reference is now made to the following descriptions taken in conjunction with the accompanying drawings, in which.

DETAILED DESCRIPTION

In the disclosed embodiments, wellbore surveying measurements and ranging measurements are integrated when drilling a second wellbore in proximity to a first wellbore. The survey measurements are used to compute a trajectory of the second wellbore. The ranging measurements are used to measure a distance between the two wellbores. The integration includes transforming a portion of a computed trajectory of the second wellbore to fit selected ones of the ranging measurements.

Example embodiments disclosed herein may provide various technical advantages and improvements over the prior art. For example, the disclosed embodiments may be advantageously used in real time while drilling and surveying the drilling well to improve wellbore intercept, avoidance, or twinning operations. The disclosed methods advantageously transform drilling well survey data such that it agrees with ranging data, thereby enabling a driller to more readily select a drilling direction that meets operational objectives. Moreover, integrating the survey and ranging data may advantageously reduce the number of required ranging measurements, and may therefore save time and other resources.

Figure 1:
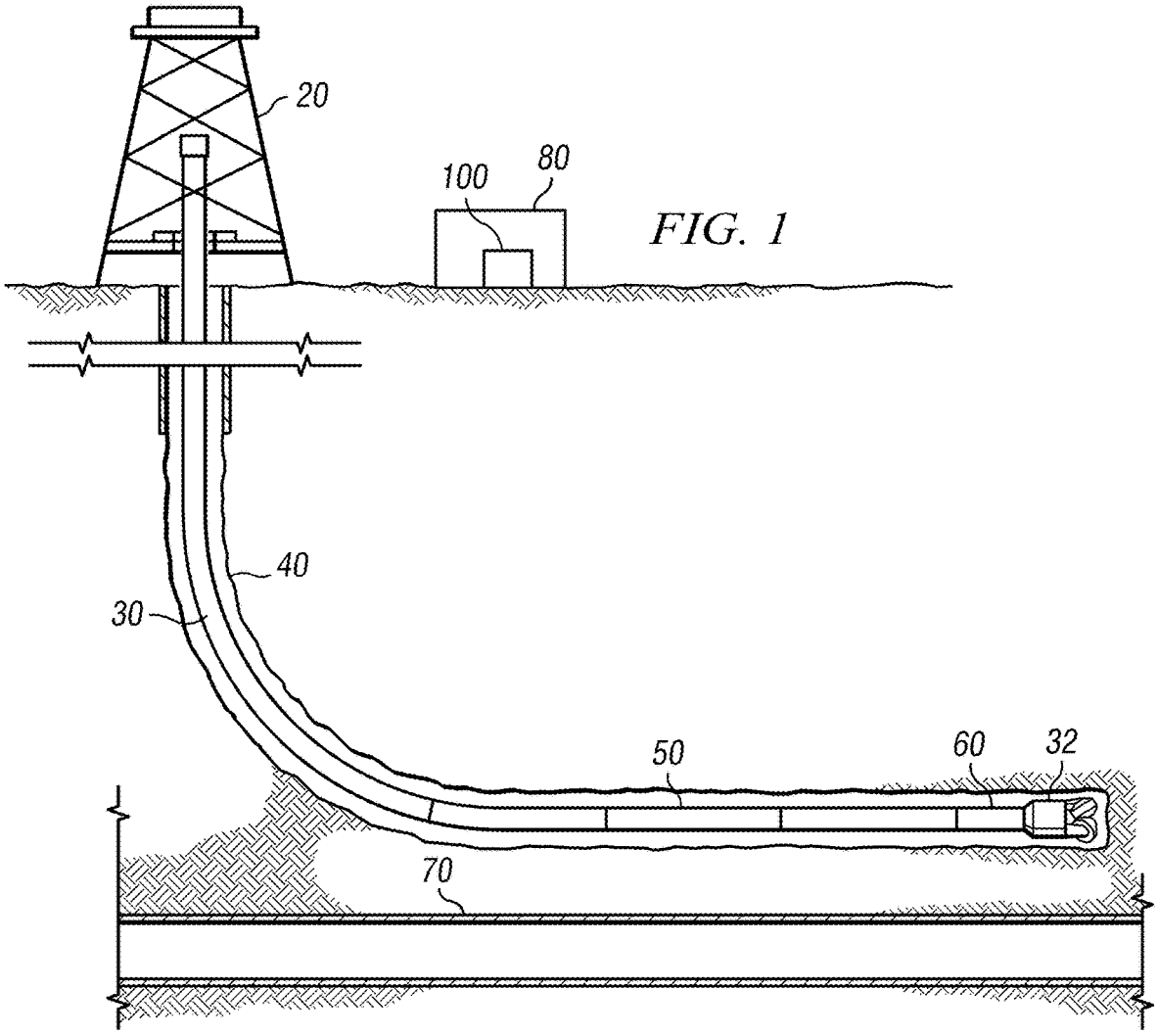
FIG. 1 depicts a drilling rig including a disclosed surveying system.

FIG. 1 depicts a drilling rig 20 including a disclosed system 100. The system 100 may be configured to receive survey measurements from a downhole surveying tool (e.g., including a measurement while drilling tool 50 or a rotary steerable system 60). In the depicted embodiment, the drilling rig 20 is positioned over a subterranean formation and may include a derrick and a hoisting apparatus (not shown) for raising and lowering a drill string 30, which, as shown, extends into wellbore 40 and includes a drill bit 32 and a surveying tool, such as a measurement while drilling (MWD) tool 50 and/or a rotary steerable system (RSS) 60. As is known to those of ordinary skill in the art, the drill string 30 may further include other tools such as a downhole drilling motor, a downhole telemetry system (e.g., deployed in or adjacent to MWD tool 50), and one or more logging while drilling (LWD) tools including various sensors for sensing downhole characteristics of the wellbore and the surrounding formation. The disclosed embodiments are expressly not limited in regards to the bottom hole assembly (BHA) configuration.

It will be understood by those of ordinary skill in the art that the deployment illustrated on FIG. 1 is merely an example. It will be further understood that disclosed embodiments are not limited to an onshore deployment as depicted. The drilling rig 20 may be deployed onshore or offshore. As is further known to those of ordinary skill, offshore rigs commonly include a platform deployed atop a riser that extends from the sea floor to the surface. The drill string extends downward from the platform, through the riser, and into the wellbore through a blowout preventer (BOP) located on the sea floor. The disclosed embodiments are expressly not limited in these regards.

With continued reference to FIG. 1, it will be appreciated that wellbore surveying measurements are commonly made while drilling a wellbore using a surveying tool deployed in the BHA. The surveying measurements generally include triaxial accelerometer measurements and triaxial magnetometer measurements and sometimes further include gyroscope measurements (e.g., in addition to or instead of the magnetometer measurements). The surveying measurements are commonly processed to determine a wellbore attitude (a wellbore heading) including a wellbore inclination and a wellbore azimuth. Static survey measurements have long been made at a discrete number of longitudinal points along the axis of the wellbore when drilling has temporarily stopped and the drill string has been lifted off the bottom of the wellbore. More recently, methods have been developed to make continuous (dynamic) survey measurements in real time while drilling. The disclosed embodiments may make use of wellbore surveying including static and/or dynamic survey measurements.

The wellbore survey measurements may be assembled into a survey of the wellbore to calculate (e.g., integrate) a three-dimensional well path (or trajectory) using the minimum curvature or another wellbore curvature assumption. The trajectory defines the position of the wellbore in three-dimensional space (e.g., in North, East, and Vertical dimensions). An ellipse of uncertainty (EOU) defines the positional uncertainty of the calculated trajectory and may be computed along the length of the wellbore from known or modelled surveying measurement errors. These errors tend to compound (or sum) with increasing depth such that the EOU increases with increasing depth (the wellbore position becomes less certain with increasing depth).

With further reference to the example depiction in FIG. 1, wellbore 40 is shown as being drilled in proximity to a section of a previously drilled wellbore 70. It will be appreciated by those of ordinary skill in the art that ranging measurements are commonly made when drilling one well (e.g., wellbore 40) in close proximity to another well (e.g., wellbore 70). Various ranging methodologies are known in the industry, for example, including active and passive magnetic ranging methods, acoustic ranging methods, and resistivity based ranging methods. The ranging measurements are intended to determine a relative position of the drilling wellbore with respect to the previously drilled wellbore (or the previously drilled wellbore with respect to the drilling wellbore). As is known in the industry, measuring the relative position between the two wells may be important in certain drilling operations such as intercept, avoidance, and twinning operations.

As noted above, the rig 20 may include a system 100 configured to combine wellbore surveying measurements and ranging measurements to assist various drilling operations such as intercept, avoidance, and twinning operations. The system 100 may be deployed at the rig site (e.g., in an onsite laboratory or office facility 80 as depicted in FIG. 1) or offsite (e.g., accessible via a networked internet connection). The disclosed embodiments are not limited in this regard. The system 100 may include computer hardware and software (e.g., a laptop or desktop personal computer) configured to receive the wellbore survey and ranging measurements and to determine a subsequent drilling direction based on the drilling objectives (e.g., towards the target well in an intercept operation, away from the target in an avoidance operation, or parallel with the target in a twinning operation). In such embodiments, the controller system 100 may include processor executable instructions stored in memory to execute selected ones of the method steps described in more detail below with respect to FIGS. 3 and 4 as well as the corresponding mathematical equations. To perform these functions, the hardware may include one or more processors (e.g., microprocessors) which may be connected to one or more data storage devices (e.g., hard drives or solid state memory). As is known to those of ordinary skill, the processors may be further connected to a network, e.g., to receive the surveying and ranging measurements or another computer system. It will, of course, be understood that the disclosed embodiments are not limited to the use of or the configuration of any particular computer hardware and/or software.

Figure 2:
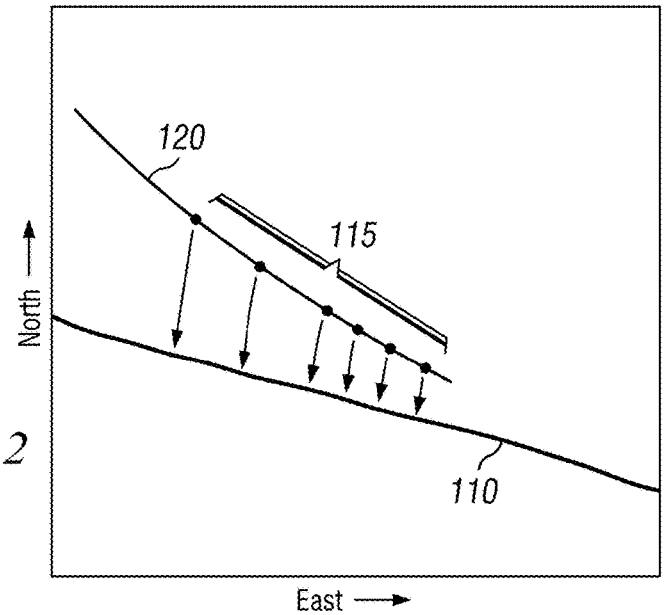
FIG. 2 schematically depicts first and second wellbores and corresponding surveying and ranging measurements.

FIG. 2 schematically depicts a plan view of first and second, target and drilling wellbores 110 and 120 in the horizontal plane. In the depicted schematic, drilling wellbore 120 is approaching target wellbore 110 from the north in an example wellbore intercept operation (although the disclosed embodiments are of course not limited in these regards and may also include wellbore avoidance and wellbore twinning operations). As described above, the trajectories of the target wellbore 110 and the drilling wellbore 120 may be estimated from survey measurements (e.g., static or dynamic survey measurements made while drilling each of the wells).

FIG. 2 further depicts ranging measurements at 115 that are made in the drilling wellbore and that measure a scalar distance or a vector distance (distance and direction) between the drilling and target wellbores. Various ranging methodologies are known in the industry, for example, including active and passive magnetic ranging methods, acoustic ranging methods, and resistivity based ranging methods. The disclosed embodiments are not limited to any particular ranging methodology and may make use of multiple types of ranging measurements. As noted above in the Background section, the survey data and ranging data commonly provide contradictory information to the driller that may cause uncertainty in making steering decisions, especially when the differences are large.

Figure 3B:
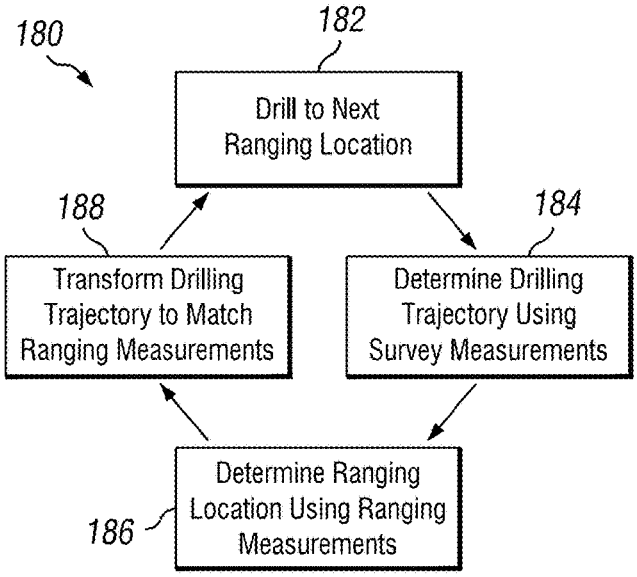
FIGS. 3A and 3B (collectively FIG. 3) depict flow diagrams of example methods for drilling a wellbore in proximity to a target well.
Figure 3A:
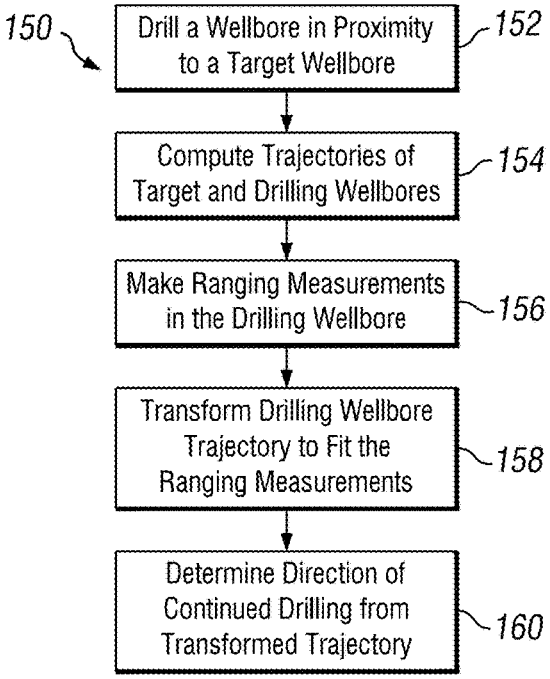

FIGS. 3A and 3B (collectively FIG. 3) depicts flow diagrams of example methods 150, 180 for drilling a wellbore in proximity to a target well. In FIG. 3A, a drilling wellbore is drilled in proximity to a target wellbore at 152. Survey measurements are made in the drilling wellbore and used to compute a trajectory of the drilling wellbore at 154. The computed trajectory may further be compared with a previously obtained trajectory of the target wellbore at 154. A plurality of ranging measurements is made along the axis of the drilling wellbore at 156 and used to estimate corresponding distances between the drilling and target wellbores. The trajectory of the drilling wellbore (or the ranging interval of the trajectory) computed at 154 is transformed to fit the plurality of ranging measurements (or selected ones thereof) at 158. The transformation at 158 includes at least a wellbore azimuth offset or a wellbore inclination offset and may include any one or more of the following: (i) a wellbore azimuth offset, (ii) a wellbore inclination offset, and (iii) a translation in three-dimensional space, for example, in the north, east, and/or vertical directions in the global north-east-down (NED) coordinate system. The transformed drilling well trajectory may then be evaluated at 160 to select or change a direction of continued drilling in the drilling wellbore (e.g., to intercept, avoid, or parallel the target wellbore).

In FIG. 3B, method 180 includes a repeating loop as depicted. A drilling well is drilled in proximity to a target well and along a predetermined direction at 182 to a ranging location (e.g., at a selected depth interval from a previous ranging location). Survey measurements may be made while drilling and are used at 184 to compute a drilling well trajectory including a first position of the drilling well at the ranging location (e.g., in the NED coordinate system). A corresponding location of the target well may also be computed at 184 using survey measurements made in the target well. One or more ranging measurements are made at the ranging location to determine a distance to the target well at 186. A second position of the drilling well may also be determined at 186 from the ranging distance and the computed distance of the target well. The drilling well trajectory determined from the survey measurements made in the drilling wellbore are transformed to fit a plurality of ranging measurement locations (e.g., three or more of the most recent ranging measurements) at 188. As described above with respect to FIG. 3A, the transformation at 188 may include any one or more of a wellbore azimuth offset, a wellbore inclination offset, and a translation of the drilling well trajectory along one-, two-, or three-dimensions. Drilling may then continue at 182, optionally along a new drilling direction determined from the transformed drilling well trajectory. It will be appreciated that method 180 may repeat steps 182, 184, 186, and 188 substantially any suitable number of times until the drilling objective has been satisfied (e.g., until the target wellbore has been successfully intercepted or avoided).

In example embodiments, the transformation at 158, 188 includes data fitting the ranging interval of the drilling well as a curve shape that can be both translated and rotated to account or correct for inclination and azimuth errors along the drilling wellbore and/or the ranging interval thereof. The rotation leading to the best fit in the horizontal plane (e.g., a plan view) may be taken to be an azimuth correction (or azimuth offset). The rotation leading to the best fit in the vertical plane may be taken to be an inclination correction (or inclination offset).

With continued reference to FIG. 3, a general transformation at 158, 188 may include both an inclination and azimuth offset rotation (a single inclination offset and/or a single azimuth offset to the set of survey measurements upon which the trajectory is computed) and a 3D translation. Such a general transformation, may be expressed mathematically, for example, as follows:

$$\begin{pmatrix} x_i' \\ y_i' \\ z_i' \\ 1 \end{pmatrix} = \begin{pmatrix} \cos(\theta)\cos(\phi) & -\sin(\theta) & \cos(\theta)\sin(\phi) & \tau_E \\ \sin(\theta)\cos(\phi) & \cos(\theta) & \sin(\theta)\sin(\phi) & \tau_N \\ -\sin(\phi) & 0 & \cos(\phi) & \tau_V \\ 0 & 0 & 0 & 1 \end{pmatrix} \cdot \begin{pmatrix} x_i \\ y_i \\ z_i \\ 1 \end{pmatrix} \tag{1}$$

where $x_i$, $y_i$, and $z_i$ represent the original three dimensional coordinates of the drilling well trajectory (based on the survey measurements), $x_i'$, $y_i'$, and $z_i'$ represent the coordinates of the transformed trajectory of the drilling well, $\theta$ represents an azimuth offset rotation (a change in azimuth leading to the best fit in the horizontal plane), $\phi$ represents an inclination offset rotation (a change in inclination leading to the best fit in the vertical plane), and $\tau_N$, $\tau_E$, and $\tau_\gamma$ represent translations in the x, y, and z directions (e.g., the North, East, and vertical dimensions in the NED coordinate system).

It will be appreciated that in example drilling operations, a simplified transformation may be used. For example, in certain embodiments the coordinate transformation may include only an azimuth offset rotation or only an inclination offset rotation (i.e., only a rotation in the vertical plane or only a rotation in the horizontal plane). For example, in embodiments that employ only an azimuth offset rotation the inclination offset rotation may be set to zero ($\phi$=0) and the transformation may be simplified accordingly. Likewise, in embodiments that employ only an inclination offset rotation the azimuth offset rotation may be set to zero ($\theta$=0) and the transformation may be simplified accordingly. Moreover, it will be further appreciated that a simplified transformation may sometimes only make use of a two-dimensional (2D) or even a one-dimensional (1D) translation. In such embodiments, one or more of $\tau_N$, $\tau_E$, and $\tau_\gamma$ may be set equal to 0.

For example only, in certain embodiments, the transformation may include only an azimuth offset rotation and a 1D, 2D, or 3D translation (e.g., a 2D translation in the East and North directions in which $\tau_\gamma$=0). In such embodiments (in which $\phi$=0), the general transformation given above may be simplified, for example, as follows:

$$\begin{pmatrix} x_i' \\ y_i' \\ z_i' \\ 1 \end{pmatrix} = \begin{pmatrix} \cos(\theta) & -\sin(\theta) & 0 & \tau_E \\ \sin(\theta) & \cos(\theta) & 0 & \tau_N \\ 0 & 0 & 1 & \tau_V \\ 0 & 0 & 0 & 1 \end{pmatrix} \cdot \begin{pmatrix} x_i \\ y_i \\ z_i \\ 1 \end{pmatrix} \tag{2}$$

It will be appreciated that such a transformation may be suitable for example drilling operations in which the wellbore azimuth measurement errors are significantly greater than the wellbore inclination measurement errors (as is common). In one example intercept operation that may make use of the above simplified transformation, the drilling well may be landed alongside and at the same vertical depth as the target well and then turned to the left or right to make the intercept.

In other example drilling operations, the transformation may include only an inclination offset rotation and a 1D, 2D, or 3D translation. In such embodiments (in which 0=0), the above given general transformation may be simplified, for example, as follows:

$$\begin{pmatrix} x_i' \\ y_i' \\ z_i' \\ 1 \end{pmatrix} = \begin{pmatrix} \cos(\theta) & 0 & \sin(\phi) & \tau_E \\ 0 & 1 & 0 & \tau_N \\ -\sin(\phi) & 0 & \cos(\phi) & \tau_V \\ 0 & 0 & 0 & 1 \end{pmatrix} \cdot \begin{pmatrix} x_i \\ y_i \\ z_i \\ 1 \end{pmatrix} \tag{3}$$

In one example intercept operation that may make use of the above simplified transformation, the drilling well may be landed above the target well and then turned downwards (dropping inclination) to make the intercept. In another example intercept operation that may make use of the above simplified transformation, the drilling well may be below the target well and then turned upwards to make the intercept. The disclosed embodiments are, of course, not limited to the above examples or even to intercept operations in general.

With further reference to FIG. 3, the survey measurements in the drilling wellbore are transformed to fit selected ranging measurements at 158, 188. In example embodiments, the fitting may minimize a difference between the transformed survey measurements and the ranging measurements (e.g., a mathematical relation that computes the difference). While the disclosed embodiments are not limited in this regard, the mathematical relation may be minimized, for example, using substantially any suitable optimization routine known to those of ordinary skill such as gradient descent or Levenberg-Marquardt techniques.

In example embodiments, the mathematical relation may include a sum of squared differences (least squares), for example, as follows:

$$f(\theta, \phi, \tau_N, \tau_E, \tau_Z) = \sum_i^n \left((x_i' - x_i'')^2 + (y_i' - y_i'')^2 + (z_i' - z_i'')^2\right)$$

where f(·) represents a mathematical relation that is related to θ, ϕ, $\tau_N$, $\tau_E$, and $\tau_Z$ and $$\sum_i^n (\cdot)$$

sums the squared differences between the transformed trajectory $x_i'$, $y_i'$, $z_i'$ and the ranging measurements $x_i''$, $y_i''$, $z_i''$ over n ranging measurements. It will be appreciated that the mathematical relation may also be simplified for simplified transformations. For example, the mathematical relation may be f(θ, $\tau_N$, $\tau_E$) when the simplified transformation shown in Eq. (2) is used or f(Ø, $\tau_N$, $\tau_E$, $\tau_Z$) when the simplified transformation shown in Eq. (3) is used. The disclosed embodiments are, of course, not limited in these regards.

With continued reference to FIG. 3, it will be appreciated that while the example transformations at 158, 188 described above with respect to Eqs. (1), (2), and (3) provide a best fit of the selected plurality of ranging locations, the transformed trajectory fits the plurality of ranging locations and will not necessarily match or equal the most recent (or last) ranging measurement. In certain example embodiments, it may be desirable to restrict the transformation such that the transformed drilling well trajectory equals (or matches) the most recent ranging measurement. This may be achieved, for example, by further translating the transformed drilling well trajectory such that it matches (or is equal to) the most recent ranging measurement.

In other example embodiments, the transformation at 158 may include computing a difference between the drilling well trajectory and the most recent ranging location to determine $\tau_E$, $\tau_N$, and $\tau_\gamma$ and determining at least one of a wellbore azimuth offset and a wellbore inclination offset to fit the drilling well trajectory to the selected plurality of ranging measurements. In one example embodiment, the wellbore azimuth offset and/or the wellbore inclination offset may be determined, for example, by substituting the determined $\tau_E$, $\tau_N$, and $\tau_\gamma$ into one of the transformation equations and optimizing to determine θ and/or ϕ.

Figure 4:
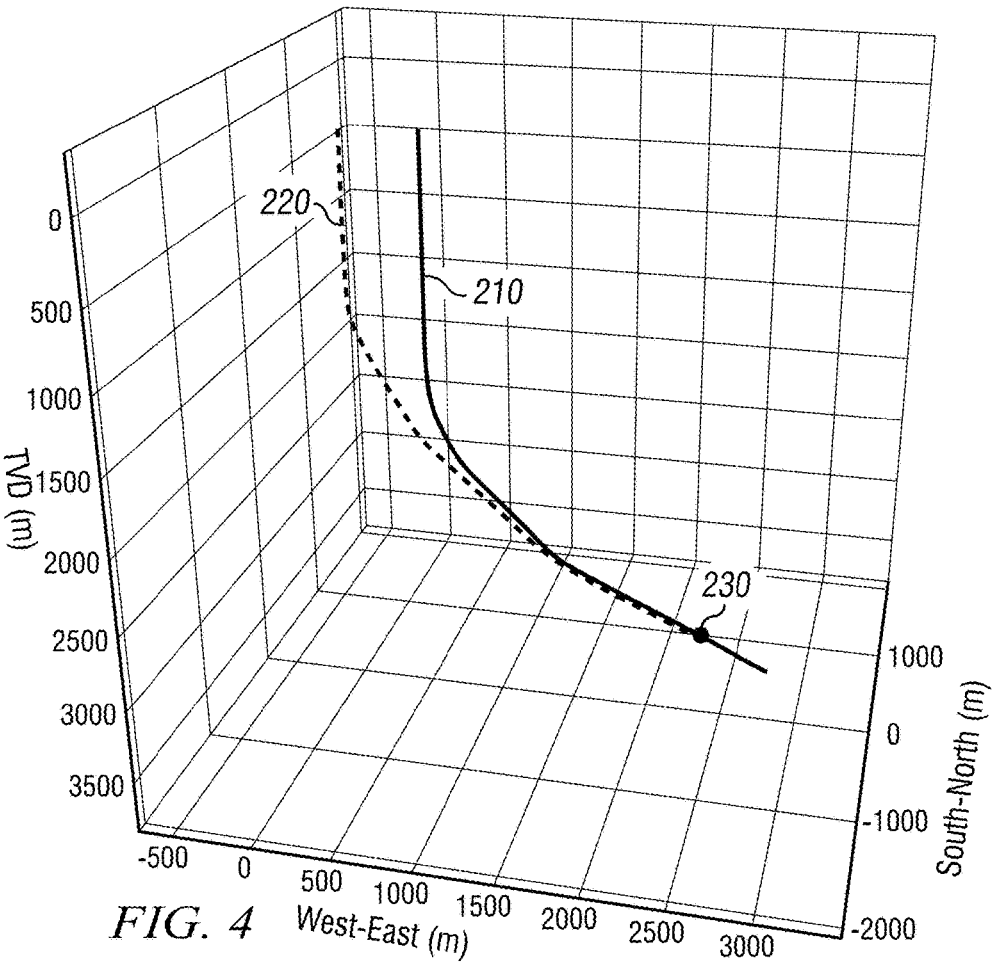
FIG. 4 depicts a three-dimensional plot of one example intercept operation that makes use of the example methods in FIG. 3.

FIG. 4 depicts a three-dimensional plot of one example intercept operation that makes use of the example methods described above with respect to FIG. 3. In the example depiction, a drilling well 220 is drilled in proximity to a previously drilled target well 210 with the intent of intercepting the target well 210, for example, at a desired intercept point 230. It will, of course, be appreciated that as described above the disclosed embodiments are not limited to intercept operations but may be equally well applied to wellbore avoidance and wellbore twinning operations.

FIGS. 5A, 5B, 5C, and 5D (collectively FIG. 5) depict plan views of the example intercept operation shown on FIG. 4 at four sequential snapshots in time. In FIG. 5, the target well trajectory is depicted at 212. The drilling well trajectory is depicted at 222. Individual ranging measurements are depicted as black diamonds at 225. The transformed (translated and rotated) drilling well trajectory obtained using the method described above with respect to FIG. 3 is depicted at 228. As described above, the drilling well trajectory is transformed to fit the ranging measurements. Note the significant discrepancy between the computed drilling well trajectory 222 and the ranging measurements 225.

Figure 5A:
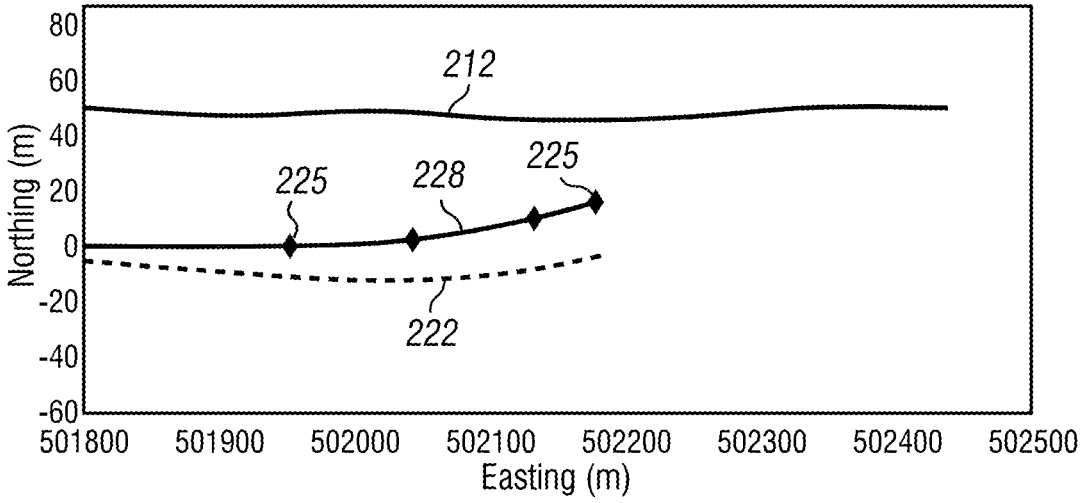
FIGS. 5A, 5B, 5C, and 5D (collectively FIG. 5) depict plan views of the example intercept operation shown on FIG. 4 as the drilling well approaches the target well.

In FIG. 5A, the drilling wellbore 222 begins to approach the target wellbore 212. However, in this example, a large offset (over 10 meters) is observed between the drilling well trajectory 222 and the four ranging measurements 225. As depicted, the computed drilling well trajectory 222 is located south (negative north) of the target well trajectory 212. In this example, the ranging measurements 225 are located between the target well 212 and the drilling well 222. The discrepancy between the drilling well trajectory 222 and the ranging measurements 225 may be described by a translation and a small angular offset (an azimuth offset in this example) as indicated by the increasing offset between the drilling well trajectory 222 and the ranging measurements 225 with increasing measured depth. At this depth, the drilling well trajectory 222 is transformed via translation and rotation to the corrected trajectory shown at 228 using Eq. (2) with θ=−2.1°, $\tau_E$=0, and $\tau_N$=10.8 meters.

Figure 5B:
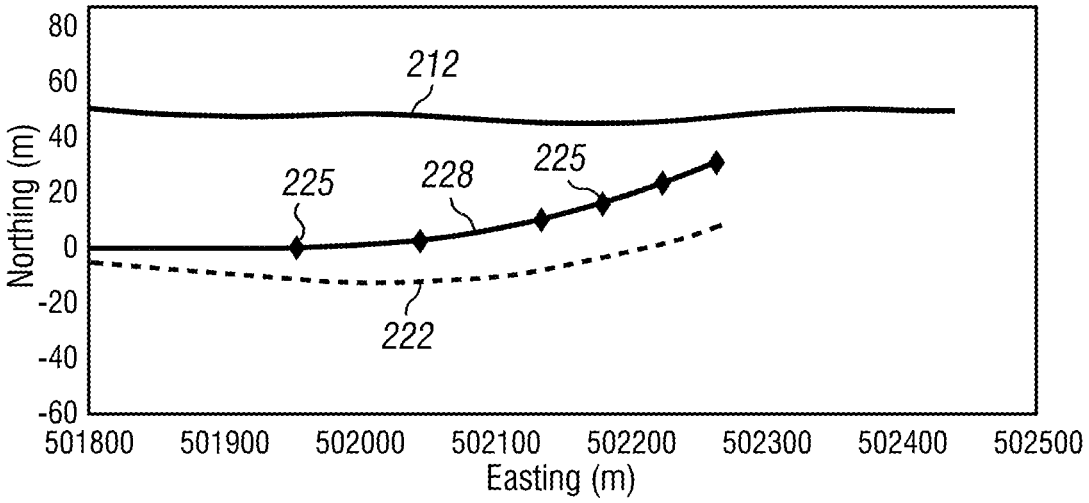

In FIG. 5B, the drilling wellbore 222 continues to approach the target wellbore 212. A total of six ranging measurements 225 have been made. The ranging measurements 225 continue to diverge from the computed drilling well trajectory 222 owing to the azimuth offset described above. As depicted, the drilling well trajectory 222 is transformed via translation and rotation to the corrected trajectory shown at 228 using Eq. (2) with θ=−2.15°, $\tau_E$=0, and $\tau_N$=11.5 meters.

Figure 5C:
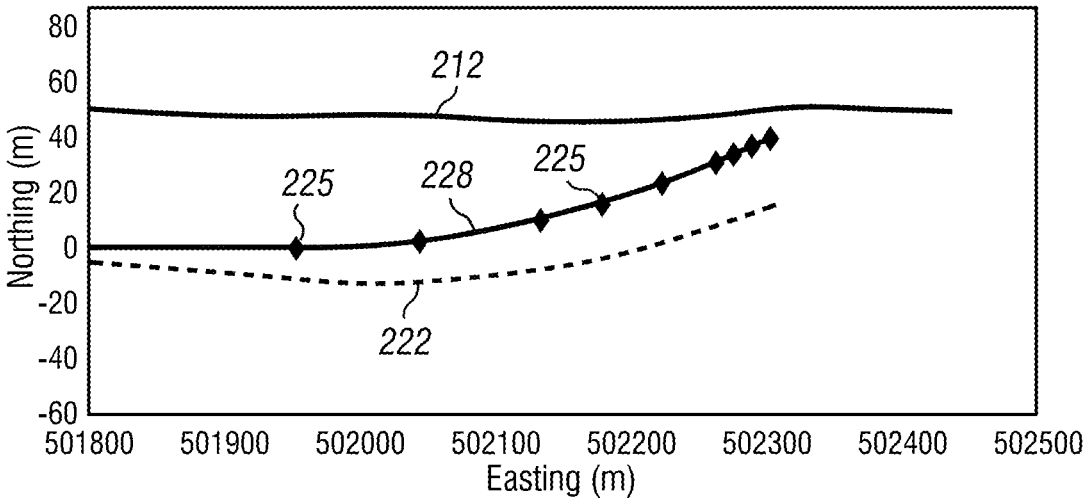

In FIG. 5C, the drilling wellbore 222 closes in on the target wellbore 212 to a distance of less than 10 meters. In this example operation, the ranging measurement 225 spacing decreases with the close approach, with a total of nine ranging measurements 225 shown. As noted above, the ranging measurements 225 continue to diverge from the computed drilling well trajectory 222 owing to the azimuth offset. As depicted, the drilling well trajectory 222 is transformed via translation and rotation to the corrected trajectory shown at 228 using Eq. (2) with θ=−2.1°, $\tau_E$=0, and $\tau_N$=10.2 meters.

Figure 5D:
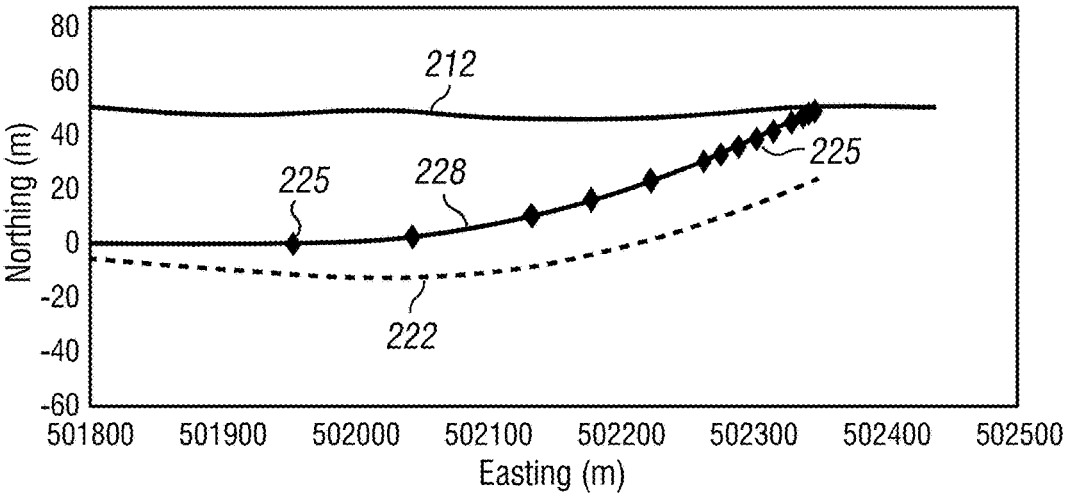

In FIG. 5D, the drilling wellbore 222 has nearly (or essentially) intercepted the target wellbore 222 (within a distance of less than 1 meter). The ranging measurement spacing remains small as the drilling wellbore 222 approaches the target wellbore 212, with a total of 14 ranging measurements 225 shown. As noted above, the ranging measurements 225 continue to diverge from the computed drilling well trajectory 222. As depicted, the drilling well trajectory 222 is transformed via translation and rotation to the corrected trajectory shown at 228 using Eq. (2) with θ=−2.2°, $\tau_E$=0, and $\tau_N$=10.5 meters.

As depicted in the example intercept operation shown on FIG. 5, the transformation may be thought of as translating (applying a spatial shift to) the drilling trajectory such that it matches one of the ranging measurements 225 (e.g., the first ranging measurement) and rotating the drilling trajectory such that it best fits all (or selected ones) of the ranging measurements 225. In this particular example, the target wellbore proceeds from west to east so that the drilling trajectory is translated in the northerly direction (with no east/west translation). The disclosed embodiments are, of course, not limited in this regard. Moreover, in this example the rotation includes only an azimuth offset. Again, as described above, the disclosed embodiments are not limited in these regards.

It will be appreciated that the transformed trajectory provides corrected survey measurements in the transformed trajectory to the driller that matches the ranging measurements. The transformed trajectory advantageously provides directional information to the driller that is consistent with the ranging measurements and may enable the driller to readily determine the subsequent drilling direction to achieve the operational objectives. Moreover, as clearly indicated in the example shown on FIG. 5, the disclosed embodiments may advantageously reduce the number of ranging measurements required and may therefore improve operational efficiency and reduce drilling time.

As described above with respect to FIG. 3, the transformation at 158, 188 includes translating and rotating the ranging interval trajectory of the drilling well to fit the ranging measurements. An example translation and rotation is depicted on FIG. 6 which includes the plan view shown on FIG. 5D. In the depicted example, the ranging interval trajectory is translated northward at 252 such that it matches the first ranging measurement 225. The translated ranging interval trajectory is shown as a dashed trajectory at 250. The translated ranging interval trajectory 250 may then be rotated at 254 to provide the best fit.

Figure 6:
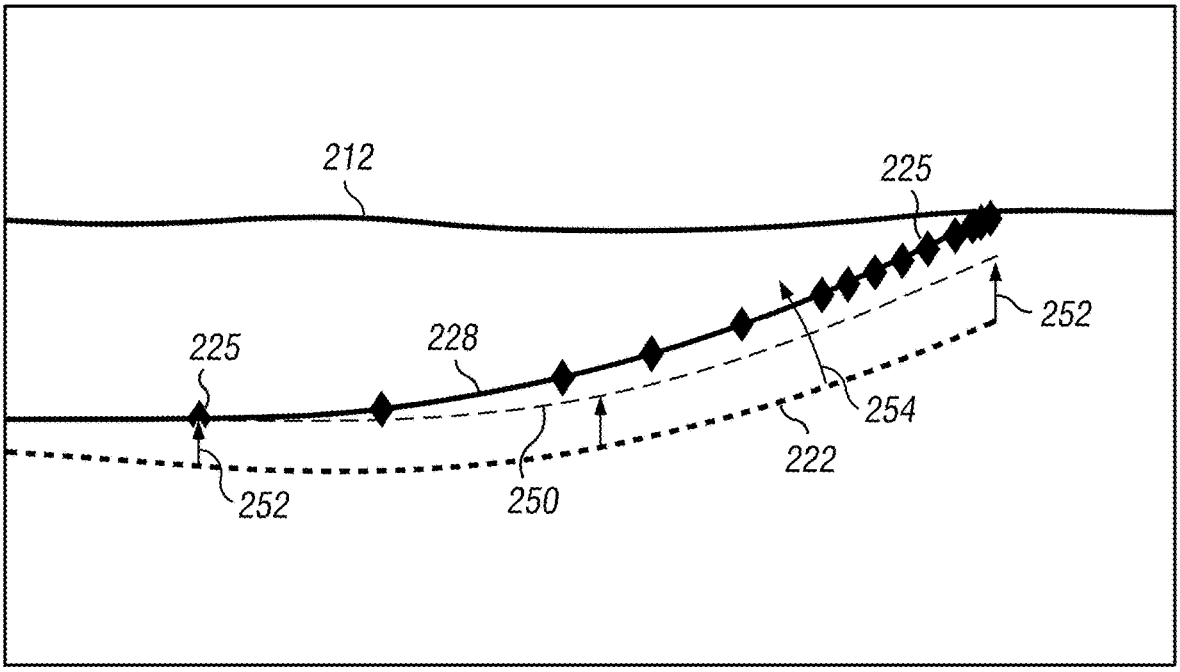
FIG. 6 depicts the plan view of FIG. 5D showing an example translation and rotation transformation.

It will be appreciated that the disclosed embodiments are not limited to the example depiction in FIG. 6. For example, ranging interval trajectory may be translated such that it matches any one of the ranging measurements (e.g., the first, the last, or any other ranging measurement). Moreover the disclosed embodiments are not limited to distinct translation and rotation operations, but may include a transformation matrix that includes both translation and rotation components as described above with respect to Eqs. (1)-(3).

Although wellbore surveying and ranging data integration and certain advantages thereof have been described in detail, it should be understood that various changes, substitutions and alterations may be made herein without departing from the spirit and scope of the disclosure.

The invention claimed is:

1. A method for drilling a second wellbore in proximity to a first wellbore, the method comprising:

obtaining a first trajectory for a first wellbore;

using a drill string to drill a second wellbore in proximity to the first wellbore;

making wellbore surveying measurements in the second wellbore using the drill string and computing a second trajectory for the second wellbore from the wellbore surveying measurements made in the second wellbore;

making a plurality of ranging measurements at a corresponding plurality of ranging locations in the second wellbore using the drill string, the plurality of ranging locations defining a ranging interval in the second wellbore, each of the plurality of ranging measurements measuring at least a distance between the first wellbore and the second wellbore;

transforming a portion of the second trajectory corresponding to the ranging interval in the second wellbore such that the portion of the second trajectory fits selected ones of the plurality of ranging measurements, wherein the transforming includes translating the portion of the second trajectory to match one of the plurality of ranging measurements and then rotating the portion of the second trajectory to obtain the fit;

determining a direction of drilling or a change in a direction of drilling of the second wellbore from the transformed portion of the second trajectory; and using the drill string to continue drilling the second wellbore along the determined direction of drilling or the determined change in the direction of drilling.

2. The method of claim 1, further comprising:

making an additional ranging measurement after the using the drill string to continue drilling to obtain a second plurality of ranging measurements including the additional ranging measurement; and repeating the transforming and the determining to determine an updated direction of drilling; and using the drill string to continue drilling the second wellbore along the updated direction of drilling.

3. The method of claim 1, wherein:

the using the drill string to drill the second wellbore comprises a wellbore intercept operation and the direction of drilling of the second wellbore is a direction towards the first wellbore;

the using the drill string to drill the second wellbore comprises a wellbore avoidance operation and the direction of drilling of the second wellbore is a direction away from the first wellbore; or the using the drill string to drill the second wellbore comprises a wellbore twinning operation and the direction of drilling of the second wellbore is a direction parallel with the first wellbore.

4. The method of claim 1, wherein the rotating comprises applying at least one of an azimuth offset in a horizontal plane and an inclination offset in a vertical plane to the portion of the second trajectory corresponding to the ranging interval in the second wellbore.

5. The method of claim 1, wherein the translating comprises translating the portion of the second trajectory to match either a first one or a last one of the plurality of ranging measurements.

6. The method of claim 1, wherein the transforming comprises multiplying the portion of the second trajectory by a transformation matrix including a rotational transformation and a translation transformation.

7. The method of claim 1, wherein the transforming further comprises minimizing a difference between the portion of the second trajectory and the selected ranging measurements to obtain the fit.

8. The method of claim 1, wherein the transforming is performed using the following mathematical relation:

$$\begin{pmatrix} x_i' \\ y_i' \\ z_i' \\ 1 \end{pmatrix} = \begin{pmatrix} \cos(\theta)\cos(\phi) & -\sin(\theta) & \cos(\theta)\sin(\phi) & \tau_E \\ \sin(\theta)\cos(\phi) & \cos(\theta) & \sin(\theta)\sin(\phi) & \tau_N \\ -\sin(\phi) & 0 & \cos(\phi) & \tau_Z \\ 0 & 0 & 0 & 1 \end{pmatrix} \cdot \begin{pmatrix} x_i \\ y_i \\ z_i \\ 1 \end{pmatrix}$$

wherein $x_i$, $y_i$, and $z_i$ represent coordinates of the portion of the second trajectory, $x_i'$, $y_i'$, and $z_i'$ represent coordinates of the transformed portion of the second trajectory, $\theta$ represents an azimuth offset rotation, $\phi$ represents an inclination offset rotation, and $\tau_E$, $\tau_N$, and $\tau_Z$ represent translations in the x, y, and z directions.

9. The method of claim 1, further comprising:

making an additional survey measurement in the second wellbore and computing an updated second trajectory after the using the drill string to continue drilling;

making an additional ranging measurement after the using the drill string to continue drilling to obtain an updated plurality of ranging measurements including the additional ranging measurement;

repeating the transforming for the updated second trajectory and the updated plurality of ranging measurements to obtain an updated transformed portion of the second trajectory;

repeating the determining a direction of drilling from the updated transformed portion of the second trajectory; and using the drill string to continue drilling the second wellbore along the updated direction of drilling.

10. A system for drilling a second wellbore in proximity to a first wellbore, the system comprising:

a drill string deployed in a second wellbore in proximity to a first wellbore, the drill string configured to drill the second wellbore along a determined direction, the drill string including a survey tool configured to make survey measurements in the second wellbore and a ranging tool configured to make ranging measurements in the second wellbore that measure at least a distance between the first wellbore and the second wellbore;

one or more processors; and memory, accessible by the one or more processors, and storing instructions that, when executed by the one or more processors, cause the one or more processors to perform operations comprising:

obtaining a first trajectory for the first wellbore;

computing a second trajectory for the second wellbore from wellbore surveying measurements made in the second wellbore using the survey tool;

obtaining a plurality of ranging measurements at a corresponding plurality of ranging locations in the second wellbore using the ranging tool, the plurality of ranging locations defining a ranging interval in the second wellbore; and transforming a portion of the second trajectory corresponding to the ranging interval in the second wellbore such that the portion of the second trajectory fits selected ones of the plurality of ranging measurements, wherein the transforming includes translating the portion of the second trajectory to match one of the plurality of ranging measurements and then rotating the portion of the second trajectory to obtain the fit; and determining a direction of drilling or a change in a direction for the drill string to drill the second wellbore from the transformed portion of the second trajectory.

11. The system of claim 10, wherein:

the rotating comprises applying at least one of an azimuth offset in a horizontal plane and an inclination offset in a vertical plane to the portion of the second trajectory corresponding to the ranging interval in the second wellbore.

12. The system of claim 10, wherein the translating the portion of the second trajectory to match either a first one or a last one of the plurality of ranging measurements.

13. The system of claim 10, wherein the transforming further comprises minimizing a difference between the portion of the second trajectory and the selected ranging measurements to obtain the fit.

14. The system of claim 10, wherein:

the surveying tool is configured to make an additional surveying measurement and the ranging tool is configured to make an additional ranging measurement after the drill string drills along the determined direction; and the instructions, when executed by the one or more processors, cause the one or more processors to perform operations further comprising:

obtaining the additional survey measurement and computing an updated second trajectory;

obtaining the additional ranging measurement and updating the plurality of ranging measurements;

repeating the transforming for the updated second trajectory and the updated plurality of ranging measurements to obtain an updated transformed portion of the second trajectory; and repeating the determining a direction of drilling from the updated transformed portion of the second trajectory.

15. A method for drilling an intercept wellbore, the method comprising:

obtaining a target trajectory for a target wellbore;

using a drill string to drill an intercept wellbore in proximity to the target wellbore;

making wellbore surveying measurements in the intercept wellbore using the drill string and computing an intercept trajectory for the intercept wellbore from the wellbore surveying measurements made in the intercept wellbore;

making a plurality of ranging measurements at a corresponding plurality of ranging locations in the intercept wellbore using the drill string, the plurality of ranging locations defining a ranging interval in the intercept wellbore, each of the plurality of ranging measurements measuring at least a distance between the target wellbore and the intercept wellbore;

translating a portion of the intercept trajectory corresponding to the ranging interval in the intercept wellbore such that the portion of the intercept trajectory matches one of the plurality of ranging measurements and then rotating the portion of the intercept trajectory to fit selected ones of the plurality of ranging measurements and obtain a transformed portion of the intercept trajectory; and determining a direction of drilling or a change in a direction of drilling of the intercept wellbore towards the target wellbore from the transformed portion of the intercept trajectory; and using the drill string to continue drilling the intercept wellbore along the determined direction of drilling or the determined change in the direction of drilling towards the target wellbore until the intercept wellbore intercepts the target wellbore.

16. The method of claim 15, wherein the using the drill string to continue drilling further comprises:

making an additional ranging measurement after the using the drill string to continue drilling to obtain an updated plurality of ranging measurements including the additional ranging measurement;

repeating the translating and the determining to determine an updated direction of drilling; and using the drill string to continue drilling the intercept wellbore along the updated direction of drilling towards the target wellbore until the intercept wellbore intercepts the target wellbore.

17. The method of claim 15, wherein the rotating comprises applying at least one of an azimuth offset in a horizontal plane and an inclination offset in a vertical plane to the portion of the intercept trajectory corresponding to the ranging interval in the second wellbore.

18. The method of claim 15, wherein the translating comprises translating the portion of the intercept trajectory to match either a first one or a last one of the plurality of ranging measurements.

19. The method of claim 15, wherein the using the drill string to continue drilling further comprises:

making an additional survey measurement in the intercept wellbore and computing an updated intercept trajectory after the using the drill string to continue drilling;

making an additional ranging measurement after the using the drill string to continue drilling to obtain an updated plurality of ranging measurements including the additional ranging measurement;

repeating the transforming for the updated intercept trajectory and the updated plurality of ranging measurements to obtain an updated transformed portion of the intercept trajectory;

repeating the determining a direction of drilling from the updated transformed portion of the intercept trajectory; and using the drill string to continue drilling the intercept wellbore along the updated direction of drilling towards the target wellbore until the intercept wellbore intercepts the target wellbore.

* * * * *